US008099022B2

(12) United States Patent
Fukaya

(10) Patent No.: US 8,099,022 B2
(45) Date of Patent: Jan. 17, 2012

(54) COLOR IMAGE FORMING APPARATUS

(75) Inventor: Hideaki Fukaya, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/415,887

(22) Filed: Mar. 31, 2009

(65) Prior Publication Data

US 2009/0252534 A1 Oct. 8, 2009

Related U.S. Application Data

(60) Provisional application No. 61/041,900, filed on Apr. 2, 2008.

(51) Int. Cl.
*G03G 15/01* (2006.01)

(52) U.S. Cl. ..... 399/167; 399/301

(58) Field of Classification Search ..... 399/167, 399/301, 394, 299; 347/116
See application file for complete search history.

(56) References Cited

U.S. PATENT DOCUMENTS 5,970,286 A * 10/1999 Numazu et al. ..... 399/167
6,404,450 B1 6/2002 Fukaya
2004/0161263 A1* 8/2004 Ehara ..... 399/167
2005/0238388 A1* 10/2005 Tanaka ..... 399/167
2007/0031166 A1* 2/2007 Zensai ..... 399/167
2007/0253735 A1* 11/2007 Sato ..... 399/167

FOREIGN PATENT DOCUMENTS

JP 2008-76546 4/2008

OTHER PUBLICATIONS

U.S. Appl. No. 61/112,108, filed Nov. 6, 2008, J. Katayama, et al.

* cited by examiner

*Primary Examiner* — Sophia S Chen
(74) *Attorney, Agent, or Firm* — Patterson & Sheridan, LLP

(57) ABSTRACT

According to an embodiment of the present invention, color drift is prevented from occurring in a color image by detecting a position of a rotation informing mechanism integrally held by one of first, second, and third gears to detect a phase change in full rotation of at least one gear, detecting a position of a rotation informing mechanism integrally held by a fourth gear to detect a phase in full rotation, and setting, on the basis of the detected one phase change and the detected other phase change, phases during start of rotation of the respective gears such that a phase of a fourth image held by an image holding member rotated by the fourth gear coincides with phases of first to third images held by respective image holding members rotated by the first, second, and third gears.

21 Claims, 8 Drawing Sheets

COLOR IMAGE FORMING APPARATUS

CROSS-REFERENCE TO RELATED APPLICATION

This application is based upon and claims the benefit of priority from: U.S. provisional application No. 61/041,900 filed on Apr. 2, 2008, the entire contents of which are incorporated herein by reference.

TECHNICAL FIELD

The present invention relates to a technique for reducing color drift during full-color image formation.

BACKGROUND

As an image forming apparatus referred to as MFP (Multi-Functional Peripheral), a full-color type having plural photoconductive drums is well known.

The full-color MFP superimposes images held by the respective photoconductive drums. Therefore, "inconsistency of overlap of the images" called color drift occurs.

There is known a technique for, in order to reduce color drift, forming test pattern images in single-color image forming units including photoconductive drums, detecting the test pattern images on an image bearing member such as a transfer belt (used for superimposing images) using a sensor for alignment control, and correcting starting positions or the like for drawing images on respective photoconductive members in the respective single-color image forming units.

For example, JP-A-2008-76546 discloses that an image forming apparatus including plural photoconductive members performs phase control for adjusting angular velocities of respective photoconductive members to prevent misalignment in image formation due to a difference in speed of the respective photoconductive members.

In JP-A-2008-76546, as phase control, the rotation of a motor is controlled while the photoconductive members make full rotation.

However, in an MFP normally including four photoconductive members and an image bearing member such as a transfer belt, it is extremely difficult to control, while the photoconductive members make full rotation, the rotation (angular velocities) of the photoconductive members to suppress fluctuation in a rotation period.

SUMMARY

It is an object of the present invention to solve, in an image forming apparatus including plural endless photoconductive members having different angular velocities during rotation, occurrence of color drift in superimposed images making use of a cause based on a phase difference during rotation among the endless photoconductive members.

According to an aspect of the present invention, there is provided a color image forming apparatus including: a first endless photoconductive member that holds a monochrome image; a second endless photoconductive member that holds an image of a first color for obtaining a color image according to a subtractive process; a third endless photoconductive member that holds an image of a second color for obtaining a color image according to the subtractive process; a fourth endless photoconductive member that holds an image of a third color for obtaining a color image according to the subtractive process; a first driving mechanism that imparts rotation for moving an image holding surface of the first endless photoconductive member in a predetermined direction; a second driving mechanism that imparts rotation for moving image holding surfaces of the second, third, and fourth endless photoconductive members in a predetermined direction; a first rotation detecting mechanism that detects a phase in full rotation of the first driving mechanism; a second rotation detecting mechanism that detects a phase in full rotation of the second driving mechanism; and a rotation control mechanism that controls the rotation of the first driving mechanism and the second driving mechanism on the basis of detection results of the first rotation detecting mechanism and the second rotation detecting mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the present invention is explained in detail below with reference to the accompanying drawings.

Figure 1:
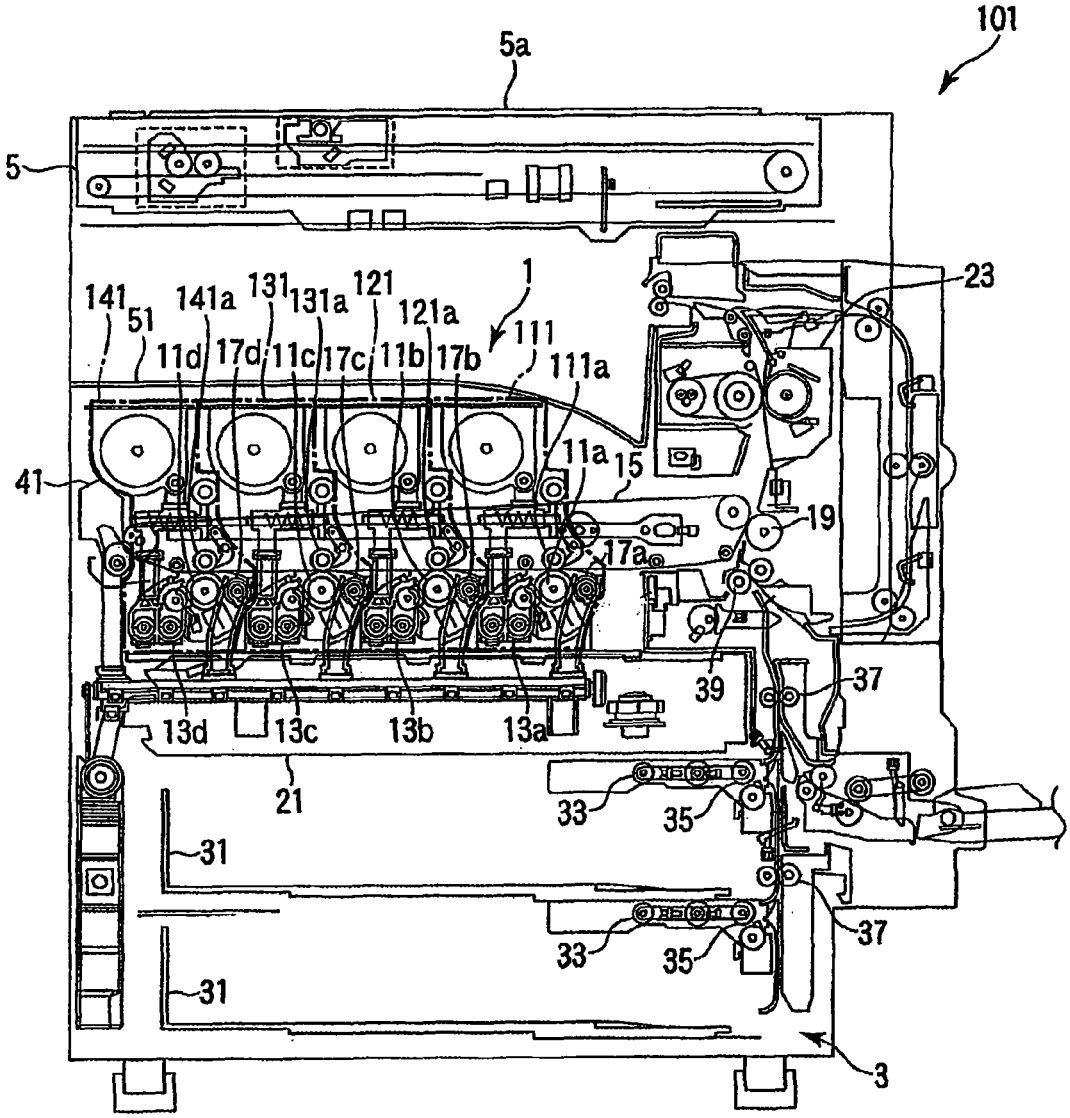
FIG. 1 is a schematic diagram of an example of an image forming apparatus (a Multi-Functional Peripheral (MFP)) according to an embodiment of the present invention.

FIG. 1 is a schematic diagram of an image forming apparatus (an MFP (Multi-Functional Peripheral)) according to the embodiment.

An image forming apparatus 101 shown in FIG. 1 includes an image forming unit main body 1 that outputs image information as "image output" in a state in which a toner image called, for example, "hard copy" or "print out" is fixed on a sheet material, a sheet feeding unit 3 that can feed a sheet (an output medium) of an arbitrary size, which is used for image output, to the image forming unit main body 1, and an image scanning unit 5 that captures, as image data, the image information, which is formed as an image in the image forming unit main body 1, from a scanning target (hereinafter referred to as original document) having the image information.

Although not explained in detail, the image scanning unit 5 includes a document table (a document glass) 5*a* that supports an original document and an image sensor, for example, a CCD sensor that converts the image information into image data. The image scanning unit 5 converts, with the CCD sensor, reflected light obtained by irradiating illumination light from an illumination device, which is not explained herein, on an original document set on the document table 5*a* into an image signal.

The image forming unit main body 1 includes first to fourth photoconductive drums 11*a* to 11*d* that hold latent images, a developing devices 13*a* to 13*d* that supply developers, i.e., toners to the latent images held by the photoconductive drums 11*a* to 11*d* to develop the latent images, a transfer belt 15 that holds, in order, toner images held by the photoconductive drums 11*a* to 11*d*, first to fourth cleaners 17*a* to 17*d* that remove the toners remaining on the photoconductive drums 11*a* to 11*d* from the respective photoconductive drums 11*a* to 11*d*, a moving device 19 that moves the toner images held by the transfer belt 15 to a sheet material, i.e., plain paper or a sheet-like medium such as an OHP sheet as a transparent sheet, a fuser unit 23 that fixes the toner images on the sheet material to which the toner images are moved, and an exposing device 21 that forms latent images on the photoconductive drums 11*a* to 11*d*.

The first to fourth developing devices 13*a* to 13*d* store toners of arbitrary colors Y (yellow), M (magenta), C (cyan), and Bk (black) used for obtaining a color image according to a subtractive process. The first to fourth developing devices 13*a* to 13*d* visualize the latent image held by each of the photoconductive drums 11*a* to 11*d* with any one of the colors Y, M, C, and Bk. Order of the colors is determined in predetermined order according to an image forming process and characteristics of the toners.

The transfer belt 15 holds, in order (of the formation of the toner images), the toner images of the respective colors formed by the first to fourth photoconductive drums 11*a* to 11*d* and the developing devices 13*a* to 13*d* corresponding thereto.

In the embodiment explained below, the first to fourth photoconductive drums 11*a* to 11*d*, the first to fourth developing devices 13*a* to 13*d*, and the first to fourth cleaners 17*a* to 17*d* are formed as units, respectively. The second to fourth units are integrally driven by using a gear train explained later. Specifically, the first photoconductive drum 11*a*, the first developing device 13*a*, and the first cleaner 17*a* are formed as a first image forming unit 111. The first image forming unit 111 is used for Bk image formation. The second photoconductive drum 11*b*, the second developing device 13*b*, and the second cleaner 17*b* are formed as a second image forming unit 121. The second image forming unit 121 is used for C image formation. The third photoconductive drum 11*c*, the third developing device 13*c*, and the third cleaner 17*c* are formed as a third image forming unit 131. The third image forming unit 131 is used for M image formation. The fourth photoconductive drum 11*d*, the fourth developing device 13*d*, and the fourth cleaner 17*d* are formed as a fourth image forming unit 141. The fourth image forming unit 141 is used for Y image formation.

Transfer rollers 111*a*, 121*a*, 131*a*, and 141*a* for moving the toner images of the respective colors held by the respective photoconductive drums 11*a* to 11*d* to the transfer belt 15 are located in positions opposed to the photoconductive drums 11*a* to 11*d* of the respective image forming units 111, 121, 131, and 141 across the transfer belt 15, i.e., positions on the inner circumference of the transfer belt 15 where the transfer belt 15 can be pressed against the photoconductive drums 11*a* to 11*d*.

The sheet feeding unit 3 feeds a sheet material, to which the toner images are moved, to the moving device 19 at predetermined timing.

Cassettes, which are not explained in detail, located in plural cassette slots 31 store sheet materials of arbitrary sizes. Pickup rollers 33 take out the sheet materials from the cassettes corresponding thereto according to an image forming operation not explained in detail. Sizes of the sheet materials correspond to magnification requested in image formation and the size of toner images formed by the image forming unit main body 1.

Separating mechanisms 35 prevent two or more sheet materials from being taken out from the cassettes by the pickup rollers 33 at a time (separate sheet materials one by one).

Plural conveying rollers 37 convey one sheet material separated by the separating mechanism 35 to aligning rollers 39.

The aligning rollers 39 send the sheet material to a transfer position, where the moving device 19 and the transfer belt 15 are in contact with each other, to be timed to coincide with timing when the moving device 19 transfers the toner images from the transfer belt 15 (the toner images move in the transfer position).

The fuser unit 23 fixes the toner images corresponding to the image information on the sheet material and sends the toner images to a stock unit 51 located in a space between the image scanning unit 5 and the image forming unit main body 1 as an image output (a hard copy or a print out).

The transfer belt 15 holds the toners remaining on the transfer belt 15 itself (hereinafter referred to as waste toners) and moves the waste toners to a predetermined position according to the movement of a belt surface of the transfer belt 15. A belt cleaner 41 that is in contact with the transfer belt 15 in a predetermined position removes the waste toners held on the belt surface of the transfer belt 15 from the transfer belt 15.

Figure 2:
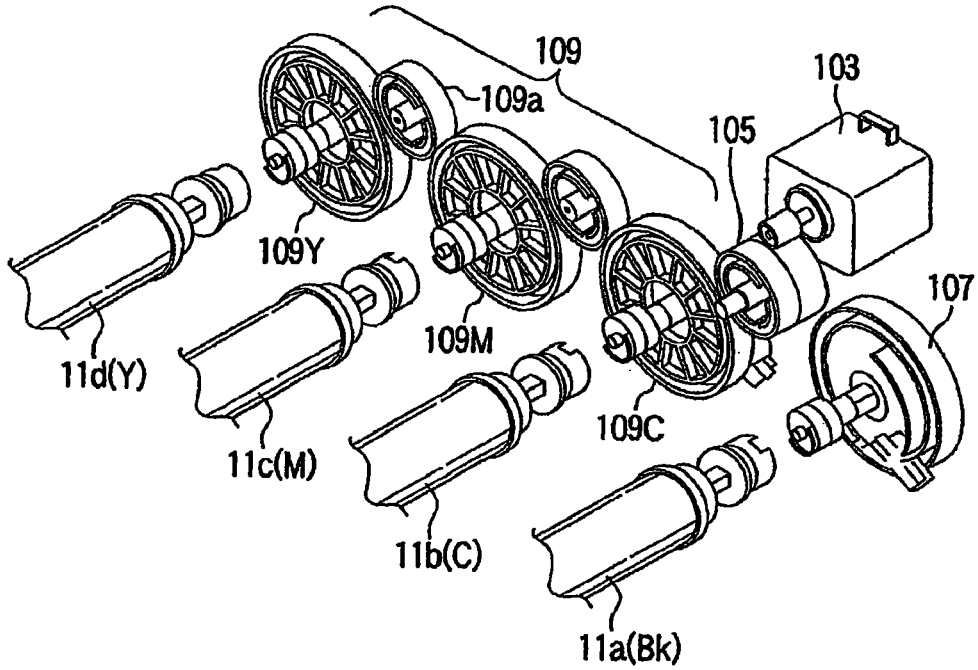
FIG. 2 is a mechanism (a gear train) for rotating respective photoconductive drums of first to fourth image forming units included in the image forming apparatus shown in FIG. 1.

FIG. 2 is a diagram of a mechanism that rotates the respective photoconductive drums 11*a* to 11*d* of the first to fourth image forming units 111, 121, 131, and 141 included in the image forming apparatus 101 shown in FIG. 1.

A driving motor 103 rotates the first photoconductive drum 11*a* (the Bk image forming unit, i.e., the first image forming unit 111) with a main transmission gear 105 and a Bk driving gear 107. The driving motor 103 also drives each of the second photoconductive drum 11*b* (the C image forming unit, i.e., the second image forming unit 121), the third photoconductive drum 11*c* (the M image forming unit, i.e., the third image forming unit 131), and the fourth photoconductive drum 11*d* (the Y image forming unit, i.e., the fourth image forming unit 141) with the main transmission gear 105 and a color driving gear train 109. The color driving gear train 109 includes a gear 109C that rotates the second photoconductive drum 11*b*, a gear 109M that rotates the third photoconductive drum 11*c*, a gear 109Y that rotates the fourth photoconductive drum 11*d*, and two idle (intermediate) gears 109*a*. Because of a reason explained later with reference to FIGS. 3, 4A, 4B and 5, the gear train 109 are assembled such that a difference in a rotation phase does not occur in each of the color photoconductive drums (Y, M, and C) 11*b*, 11*c*, and 11*d* driven by each of the gear 109C, the gear 109M, and the idle gears 109Y.

The main transmission gear 105 includes a not-shown moving mechanism. The moving mechanism can be located in a first position for rotating only the Bk driving gear 107 and a second position for rotating both the Bk driving gear 107 and the gear 109C (the color driving gear train 109). Therefore, when the moving mechanism is located in the first position, the main transmission gear 105 rotates only the first photoconductive member (for Bk) 11*a*. When the moving mechanism is located in the second position, the main transmission gear 105 rotates all of the first photoconductive member (for Bk) 11*a*, the second photoconductive member (for C) 11*b*, the third photoconductive member (for M) 11*c*, and the fourth photoconductive member (for Y) 11*d*.

Figure 3:
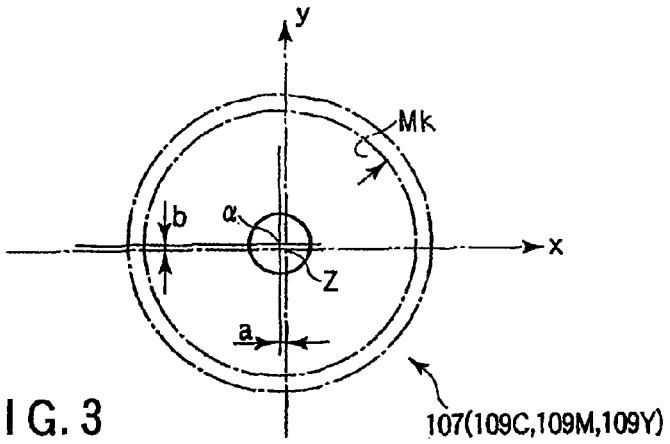
FIG. 3 is a diagram of a characteristic of a Bk driving gear or each of gears included in a color driving gear train shown in FIG. 2.

FIG. 3 is a diagram of a characteristic of the Bk driving gear 107 or each of the gear 109C, the gear 109M, and the gear 109Y.

Except for a special example, the respective gears are formed by molding. Therefore, as shown in FIG. 3, a peculiar shaft a occurs between the center (denoted by sign "z") that is coupled to a driving shaft of an arbitrary photoconductive drum (any one of the photoconductive drums) and the center (denoted by sign "c") of a center hole. When a coordinate of the center "z" of the gear is x=0 and y=0, in an x-y coordinate system, a can be indicated by x=a and y=b ("a" and "b" are arbitrary numbers, respectively). When there are two or more dies used for molding of the gears, the peculiar shift α equivalent to the number of dies occurs. According to such a background, each of the gears integrally includes a marker Mk that allows a user to identify in which direction the shift α occurs with respect to the center "z" of the center hole when the gear is coupled to the driving shaft of the photoconductive drum. It is needless to explain that a positional relation of the marker Mk with the center "z" of the center hole is always in the same condition with respect to the gear formed by the mold.

Figure 4A:
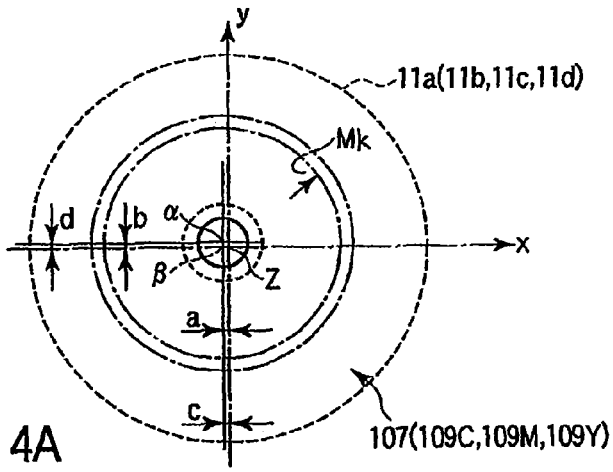
FIGS. 4A and 4B are diagrams of a peculiar shift $\alpha$ between the center "z" of the gear and the center "c" of a center hole and a shift between the center "z" of the gear and the center of a driving shaft of an arbitrary photoconductive drum.
Figure 4B:
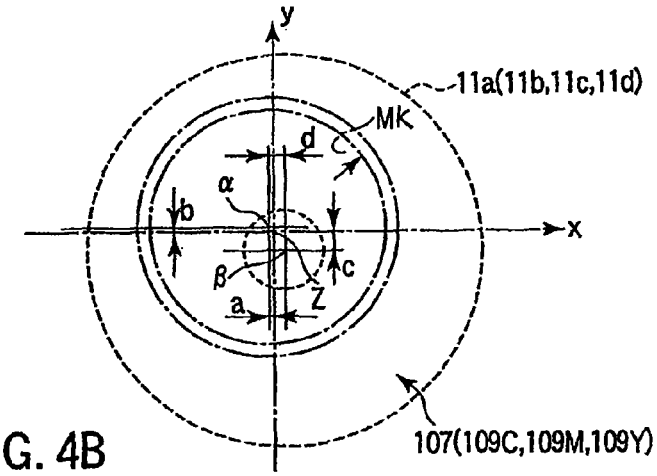

FIGS. 4A and 4B are diagrams of the peculiar shift α between the center "z" of the gear and the center "c" of the center hole and a shift between the center "z" of the gear and the center of a driving shaft of an arbitrary photoconductive drum.

In the Bk driving gear 107 or any one of the gear 109C, the gear 109M, and the gear 109Y, a peculiar shift β occurs between the center of a driving shaft of an arbitrary photoconductive drum and the center "z" of the gear. When a coordinate of the center "z" of the driving shaft is x=0 and y=0, in an x-y coordinate system, the peculiar shift β can be indicated by x=c and y=d ("c" and "d" are arbitrary numbers, respectively). Therefore, the shifts α and β between the Bk driving gear 107 or any one of the gear 109C, the gear 109M, and the gear 109Y and the driving shaft of the photoconductive drum cancel each other as shown in FIG. 4A or accumulate each other as shown in FIG. 4B.

A relation same as the relation between the center of the gear and the center of the center hole is present between the photoconductive drum and the driving shaft (not explained in detail) and between the center of a coupler (not explained in detail) that transmits the rotation of the gear to the driving shaft and the center of a center hole of the coupler. Therefore, the influence of rotation phases of the four photoconductive drums can be reduced by calculating in advance the peculiar shift for all the elements and assembling the elements with the direction of the shift associated with the elements.

Figure 5:
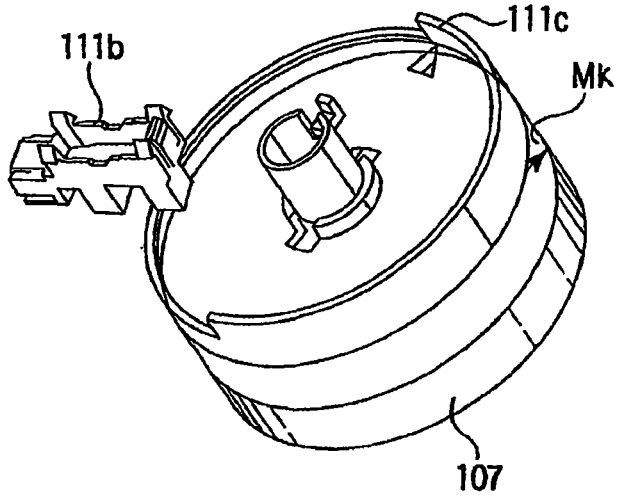
FIG. 5 is a diagram of a characteristic of the Bk driving gear.

FIG. 5 is a diagram of a characteristic of the Bk driving gear 107. The Bk driving gear 107 includes a wall-like projection 111*c* that informs, for example, a photo interrupter type rotation angle sensor 111*b*, which is located near the Bk driving gear 107, of a degree of rotation from the marker Mk, i.e., a rotation phase. The projection 111*c* is concentric with the center hole of the gear 107. The projection 111*c* is prepared about 180 degrees in a predetermined radial position of the gear 107. Therefore, a rotation phase of the photoconductive drum 11*a* (Bk) rotated by the gear 107 can be calculated from a positional relation between the marker Mk and the projection 111*c* and a detection output by the sensor 111*b*.

Figure 6:
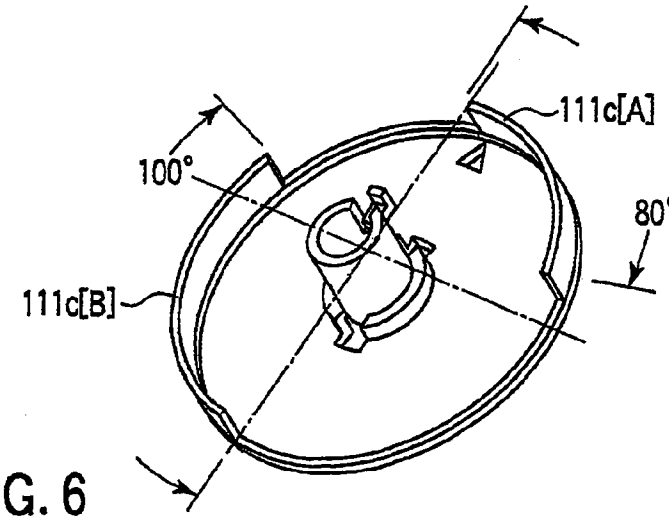
FIG. 6 is a diagram of another form of the characteristic of the Bk driving gear show in FIG. 5.

As indicated by A and B in FIG. 6, the projection 111*c* may be prepared in two places at an interval of about 90 degrees in predetermined radial positions of the gear 107. In an example shown in FIG. 6, when the lengths (in a circumferential direction) of the projections 111*c* are set to, for example, 80 degrees and 100 degrees and the interval is set to 90 degrees, a rotation phase of the photoconductive drum 11*a* (Bk) rotated by the gear 107 can be detected while the gear 107 makes half rotation.

Concerning the gear 109C of the color driving gear train 109 (the second image forming unit (C) 121), as explained with the Bk driving gear 107 as the example with reference to FIG. 5, a rotation phase of the photoconductive drum 11*b* (C) rotated by the gear 109C can be calculated by providing a wall-like projection 121*c* that informs a degree of rotation from the marker Mk, i.e., a rotation phase and detecting the projection 121*c* with the sensor 121*b*. The projection 121*c* is formed by molding in the same manner as the projection 111*c*.

Therefore, a shift of a phase between the photoconductive drum 11*c* (C) and the photoconductive drum 11*a* (Bk) can be calculated according to output of the sensor 121*b* and output of the sensor 111*b*. The gear 109C that rotates the photoconductive drum 11*b* of the C image forming unit 121, the gear 109M that rotates the photoconductive drum 11*c* of the M image forming unit 131, and the gear 109Y that rotates the photoconductive drum 11*d* of the Y image forming unit 141 are set such that rotation phases thereof are made substantially equal by the gear train 109. Therefore, the projection is provided in at least one of the gears 109C, 109M, and 109Y other than the gear 107 that rotates the photoconductive drum 11*a* (Bk). This makes it possible to adjust the rotation phases to be equal. On the other hand, if the projection 121*c*, a projection 131*c*, and a projection 141*c* are respectively provided in the gear 109C, the gear 109M, and the gear 109Y of the color driving gear train 109 and the projections 121*c*, 131*c*, and 141*c* are respectively detected by sensors 121*b*, 131*b*, and 141*b* located in predetermined positions corresponding to the projections, it goes without saying that all rotation phases of the photoconductive drum 11*a* (the drum for Bk), the photoconductive drum 11*b* (the drum for C), the photoconductive drum 11*c* (the drum for M), and the photoconductive drum 11*d* (the drum for Y) can be calculated.

Figure 7:
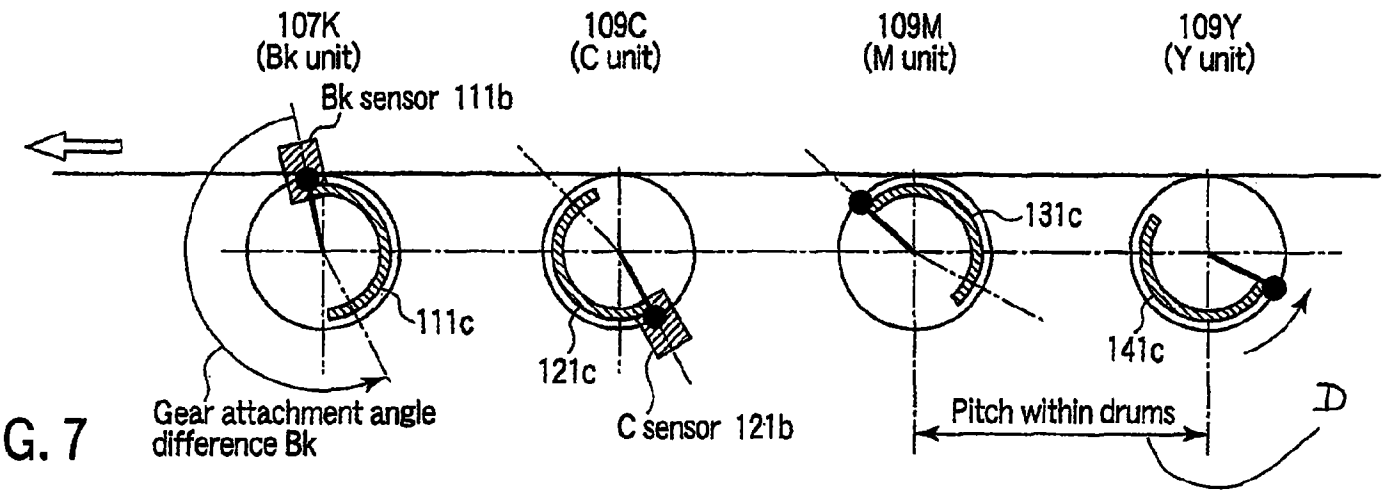
FIG. 7 is a diagram of a relation between projections (the gear) shown in FIG. 5 (FIG. 6) and sensor outputs.

FIG. 7 is a diagram of a relation between the projections (the gear) shown in FIG. 5 (FIG. 6) and sensor outputs.

In an arbitrary gear, since a positional relation between the marker Mk explained with reference to FIG. 3 and the projection 111*c* (121*c*, 131*c*, or 141*c*) is evident, an attachment angle Ca between the marker Mk and the projection is fixed. Therefore, if each of the image forming units is assembled such that the attachment angle Ca between the marker Mk and the projection is equivalent to, for example, an inter-drum pitch D between the image forming units, the image forming unit can be assembled such that an arbitrary gear attachment angle difference between not only the Bk and C units (the first and second units) but also between the C and M units (the second and third units) or between the M and Y units (the third and fourth units) is completely the same angle difference according to the following formula:

$$\text{gear attachment angle difference } C = 360° \times \text{inter-drum pitch } D / (\text{photoconductive drum diameter} \times \pi).$$

Figure 8A:
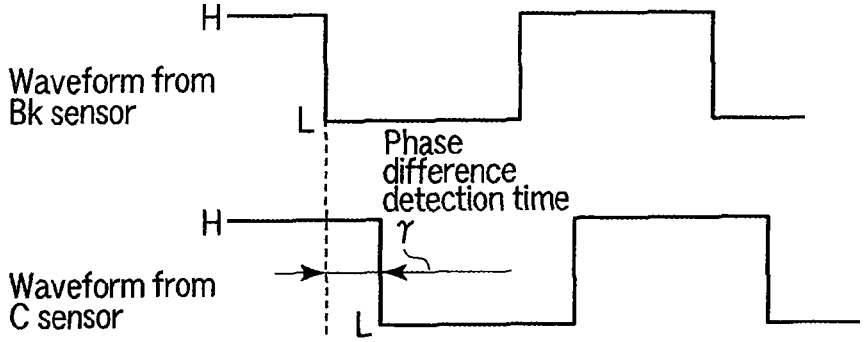
FIGS. 8A and 8B are diagrams of sensor outputs from sensors of arbitrary two image forming units having a positional relation shown in FIG. 7.
Figure 8B:
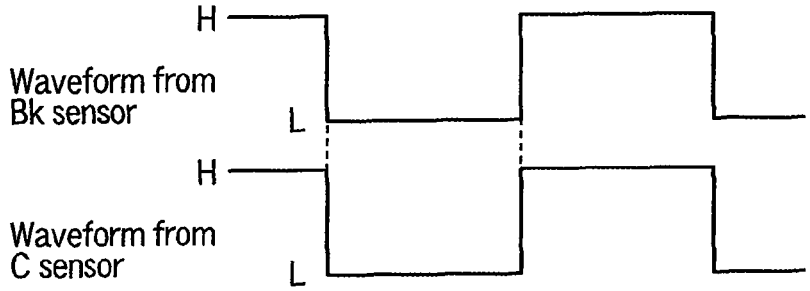

FIGS. 8A and 8B are diagrams of sensor outputs from sensors of arbitrary two image forming units having the positional relation shown in FIG. 7.

FIG. 8A indicates that a rotation period of the photoconductive drum 11*b* of the C image forming unit 121 shifts by time γ with respect to a rotation period of the photoconductive drum 11*a* of the Bk image forming unit 111. FIG. 8B indicates that a rotation period of the photoconductive drum 11*a* of the Bk image forming unit 111 and a rotation period of the photoconductive drum 11*b* of the C image forming unit 121 coincide with each other (there is no shift).

Figure 9:
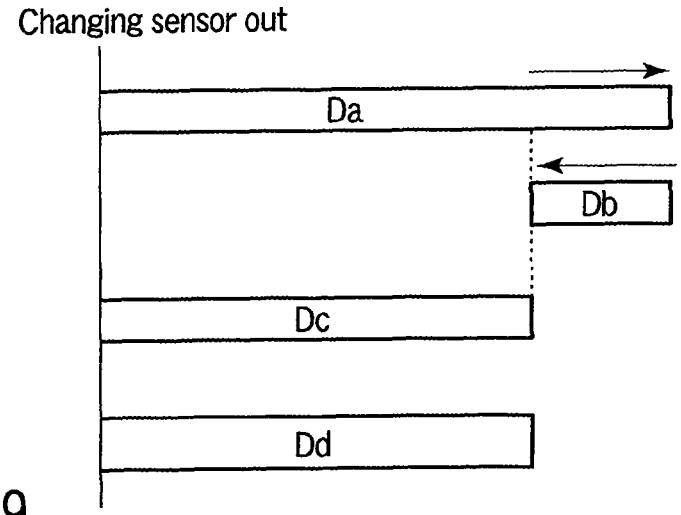
FIG. 9 is a schematic diagram of control during rotation stop for photoconductive drums of the arbitrary two image forming units.

FIG. 9 is a schematic diagram of control during rotation stop for photoconductive drums of arbitrary two image forming units. The control during stop is useful for preventing a rotation phase difference between the photoconductive drums from causing color drift. If rotation phases of the respective drums are set the same, time necessary for phase matching during start for the next image formation can be reduced. As a result, time for obtaining a print out can be reduced.

When a stop state of the photoconductive drums of the two image forming units exceeds a tolerance level by γ as shown in FIG. 8A, a phase difference can be eliminated by stopping the photoconductive drum 11*b* (the C drum) earlier by γ (time).

In some case, the photoconductive drums of the respective image forming units are reversely rotated after the stop in order to remove objects as causes of deterioration in cleaning performance such as toners and paper powder (e.g., fiber formed when the sheet material is plain paper and pigment used for adjusting whitening and hardness) adhering to, for example, (not-shown) cleaning blades (built in the first to fourth cleaners 17*a* to 17*d*). Therefore, as shown in FIG. 9, when a moving distance at driving stop during normal rotation (a drum circumferential surface) is represented as Da and a moving distance during reverse rotation (the drum circumferential surface) is represented as Db, a moving distance from a sensor changing point is specified as Dc=Da−Db when reverse rotation control is performed and a moving distance from the sensor changing point is specified as Dd (=Dc) when the reverse rotation control is not performed. This makes it possible to eliminate a phase difference between the photoconductive drums (the image forming units).

The detection of a phase difference and the correction of a stop position are preferably carried out during power-on (e.g., during warming up) of the image forming apparatus.

Figure 10:
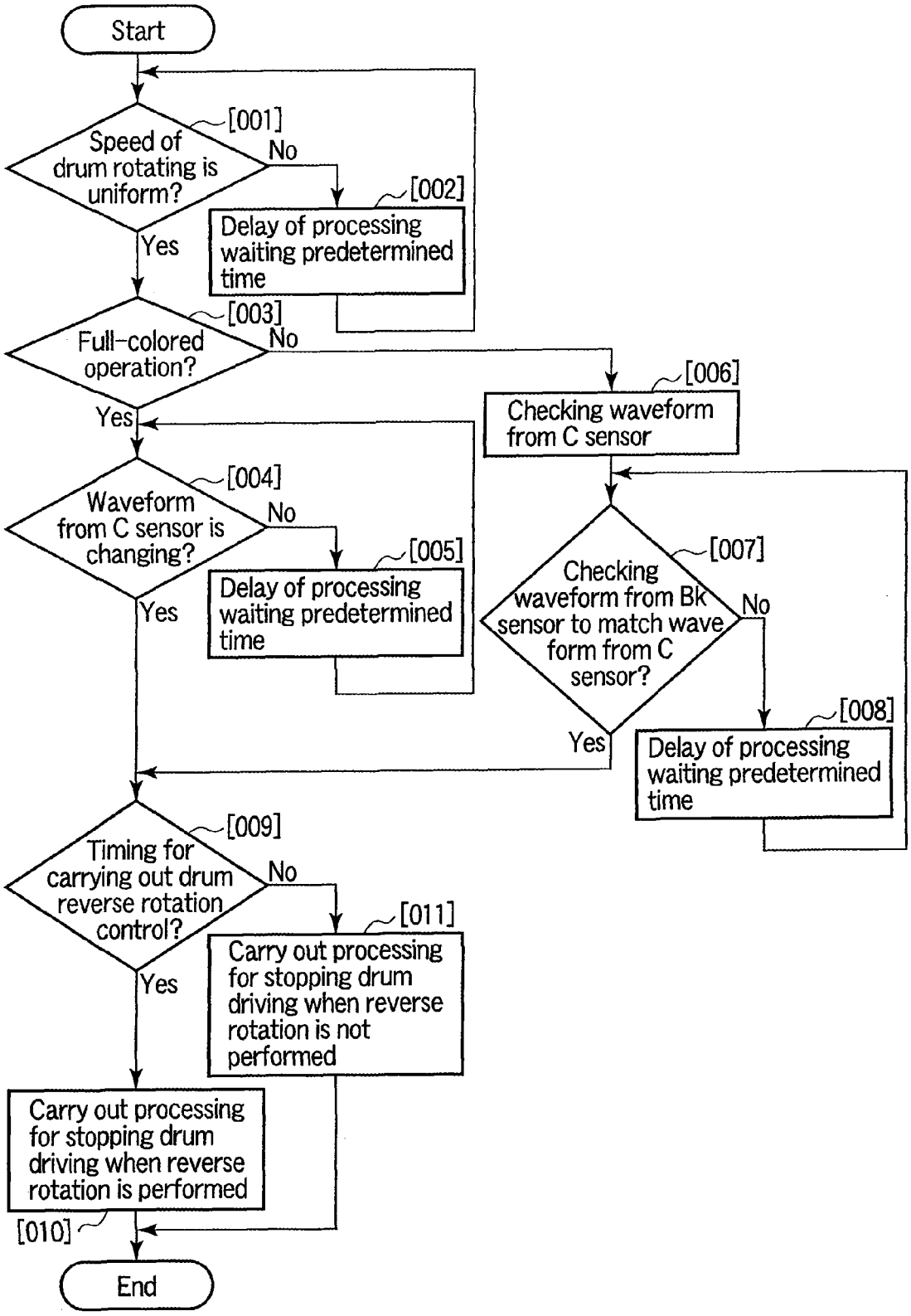
FIG. 10 is a flowchart of a flow for detecting a difference in a rotation phase and correcting a stop position during power-on (e.g., warming up) of the image forming apparatus.

As an example, according to a flow shown in FIG. 10, the image forming apparatus detects whether drum rotating speed is uniform speed (whether rotating speed of the driving motor is stabilized after start) [ACT 001]. If the motor speed is not stabilized [ACT 001, NO], the image forming apparatus stays on standby for a fixed time [ACT 002]. At a point when it is detected that the motor speed is stabilized (the rotation of the driving motor is uniform speed rotation) [ACT 001, YES], the image forming apparatus determines whether an operation thereof is a full-color operation (output) (or monochrome output) [ACT 003].

If the operation is the full color operation (color image output) [ACT 003, YES], the image forming apparatus detects a rotation period of a photoconductive drum of a unit other than the Bk image forming unit, for example, a rotation period of the photoconductive drum of the C image forming unit (presence or absence of a change in a state of the C sensor) [ACT 004]. The image forming apparatus repeats the check at every fixed time until a state change of the C sensor occurs [ACT 005].

At a point when a state of the C sensor, i.e., a rotation phase of the photoconductive drum of the C image forming unit can be detected [ACT 004, YES or ACT 007, YES (explained later)], the image forming apparatus determines whether reverse rotation of the photoconductive drum is necessary (whether timing for carrying out reverse rotation control of the photoconductive drum comes) [ACT 009]. If the reverse rotation is necessary [ACT 009, YES], the image forming apparatus carries out processing for stopping the drum driving when the reverse rotation is performed [ACT 010]. If the reverse rotation is unnecessary [ACT 009, NO], the image forming apparatus carries out processing for stopping the drum driving when the reverse rotation is not performed [ACT 011]

On the other hand, when the operation is a monochrome operation [ACT 003, NO], in order to reduce time for phase matching during start when the next image formation (start) is performed in full color, i.e., in order to match a phase of the Bk drum to a phase of the stopped C drum, the image forming apparatus does not stop the rotation of the motor until a state of the C sensor is acquired (a change to a state matching a phase of the C drum (if a state of the sensor of the C drum is H, output of the sensor of the Bk drum changes from L to H) is detected) [ACT 007].

Thereafter, at a point when a state of the sensor of the Bk drum changes, i.e., at a point when the state of the sensor of the Bk drum changes to the state of the C sensor (a rotation phase of the C drum) [ACT 007, YES], the image forming apparatus determines whether the reverse rotation of the photoconductive drum is necessary [ACT 009] as described above.

On the other hand, until a state of the sensor of the Bk drum changes [ACT 007, NO], the image forming apparatus checks sensor output at every fixed time [ACT 008].

Figures 11A, 11B, 11C, 11D:
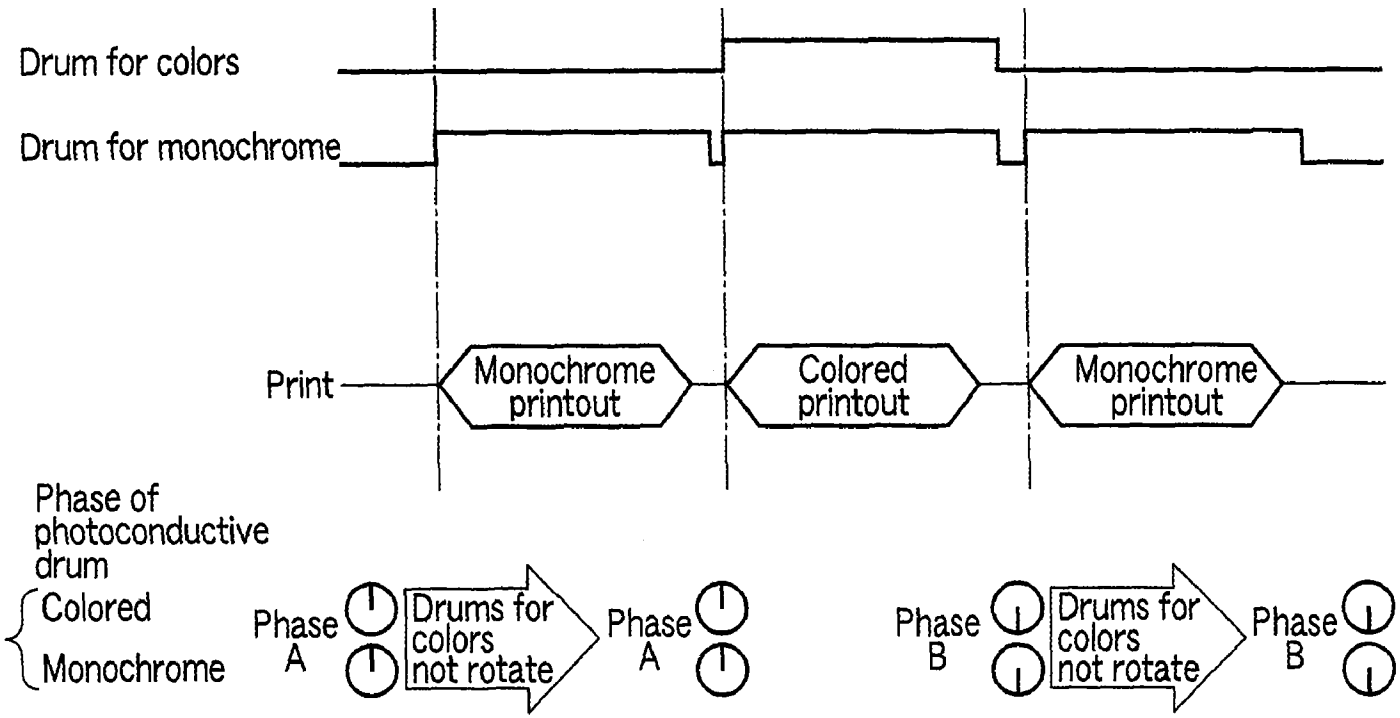
FIGS. 11A to 11D are diagrams of an example of operation timing of a Bk image forming unit (for monochrome output) and image forming units other than the Bk image forming unit in image output in which color output and monochrome output are mixed.

For example, when, as shown in FIGS. 11A to 11D, it is detected in an automatic color detection mode that color output and monochrome output are mixed and, as shown in FIG. 11C, "monochrome output (print)"-"color output (print)"-"monochrome output (print)" are repeated, the Bk photoconductive drum 11*a* (the first image forming unit 111) rotates during any output (image formation) as shown in FIG. 11B. Conversely, the C photoconductive drum 11*b* (the second image forming unit 121), the M photoconductive drum 11*c* (the third image forming unit 131), and the Y photoconductive drum 11*d* (the fourth image forming unit 141) rotate only during color output as shown in FIG. 11A.

Therefore, at timing shown in FIG. 11D, i.e., during transition from the monochrome output to the color output, a stop position (the drum circumferential surface) of the monochrome photoconductive drum (the Bk photoconductive member) 11*a* is aligned with stop positions of the color photoconductive members (the C photoconductive member 11*b*, the M photoconductive member 11*c*, and the Y photoconductive member 11*d*) to prevent a phase shift from occurring in rotation phases of the respective photoconductive drums.

During the monochrome output, the photoconductive drums for color output (the C photoconductive member 11*b* (the second image forming unit 121), the M photoconductive member 11*c* (the third image forming unit 131), and the Y photoconductive member 11*d* (the fourth image forming unit 141)) are stopped.

In this state, during the transition from the monochrome output to the color output, the monochrome photoconductive drum 11*a* (the first image forming unit 111) is adjusted to a stop position for color output start to prevent a phase shift from occurring in each photoconductive member. On the other hand, during color print, since the photoconductive drums rotate in a phase-matched state, a phase shift does not occur during transition from the color output to the monochrome output and during stop. As explained already, the color photoconductive members (the C photoconductive member 11*b*, the M photoconductive member 11*c*, and the Y photoconductive member 11*d*) rotate in a state in which rotation phases are matched by the color driving gear train 109 (see FIG. 2). Therefore, for example, if a phase of the C photoconductive drum is detected and a phase of the Bk photoconductive drum is matched to the phase, phase control for the color output is completed. In other words, if the respective photoconductive drums are stopped in such a manner that [A] for the color output, the monochrome photoconductive drum is stopped in a phase A, [B] during the color output, a stop position is set in the phase A or a phase B, and [C] for start of the color output, the monochrome drum is stopped in the phase B, time until a print out is obtained during start is reduced.

Figure 12A:
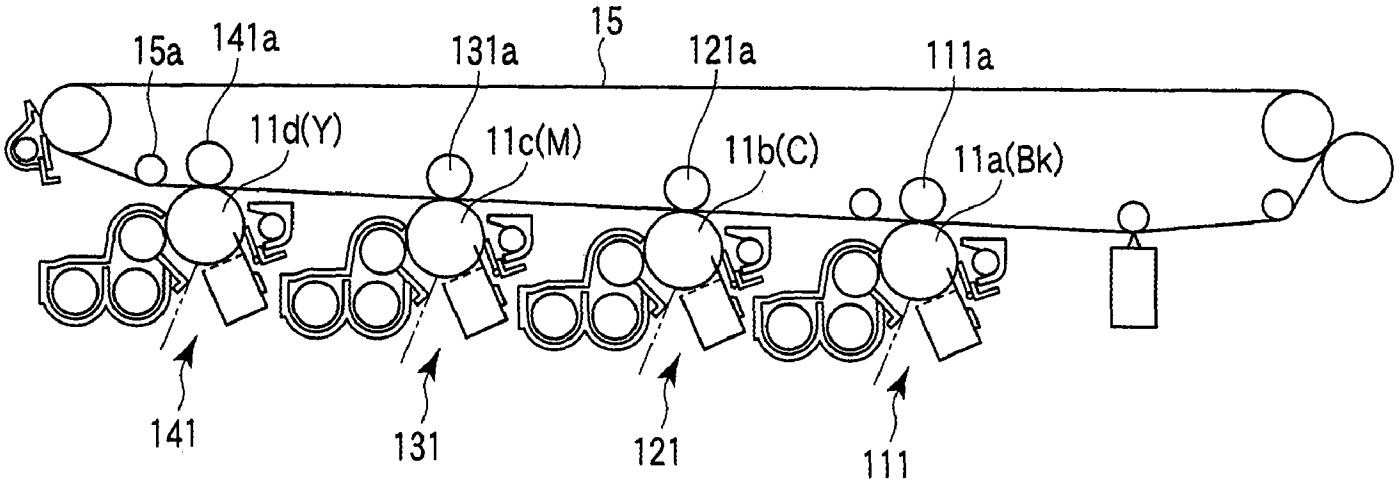
FIGS. 12A and 12B are diagrams of an example of a relation between operations of the Bk image forming unit (for monochrome output) and the image forming unit other than Bk image forming unit explained in FIGS. 11A to 11D and setting of transfer pressure to a transfer belt (see FIG. 1).
Figure 12B:
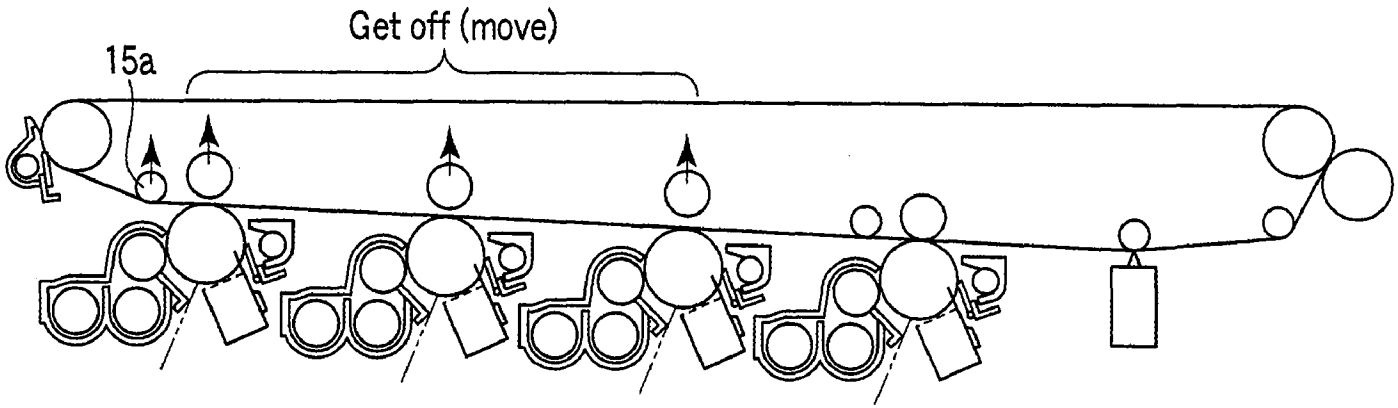

FIGS. 12A and 12B are diagrams of an example of a relation between operations of the Bk image forming unit (for monochrome output) and the image forming units other than Bk image forming unit explained with reference to FIGS. 11A to 11D and setting of transfer pressure on the transfer belt (see FIG. 1).

During the monochrome output, the C transfer roller 121*a*, the M transfer roller 131*a*, and the Y transfer roller 141*a* and a tension roller 15*a* are separated from the transfer belt 15 to the inner side of the transfer belt 15 by a not-shown pressure release mechanism (all the transfer rollers 111*a*, 121*a*, 131*a*, and 141*a* shown in FIG. 12A change positions as shown in FIG. 12B from a state in which the transfer rollers are in contact with the transfer belt 15 from the rear surface thereof). Therefore, the contact of each of the photoconductive drums 11*b*, 11*c*, and 11*d* other than the Bk photoconductive drum 11*a* with the transfer belt 15 is released. Consequently, during non-color output, the durable life of the C image forming unit 121, the M image forming unit 131, and the Y image forming unit 141 other than the Bk image forming unit can be extended.

As explained above, the present invention is characterized by using at least two or more sensors in order to detect rotation period fluctuation of the photoconductive drums.

Further, the present invention is characterized by controlling, to eliminate a rotation phase difference in the plural photoconductive drums, a rotation period of the driving motor that rotates the photoconductive drums and timing for stopping the photoconductive drums.

Moreover, the present invention is characterized by carrying out, if the photoconductive drums are in a state in which the photoconductive drums cause color drift during power-on (e.g., during warming up) (if a rotation phase difference exceeds a tolerance level), control for correcting the phase difference.

Furthermore, the present invention is characterized by not starting sensor detection for phase difference detection until rotating speed of the photoconductive drums is fixed.

When printing is finished, timing for stopping the driving is controlled such that a rotation phase difference does not occur depending on presence or absence of reverse rotation control for the photoconductive drums and a phase difference is corrected during power on. Therefore, when printing is started, the photoconductive drums are in a state in which there is no rotation phase difference. During start (when print output is instructed), it is unnecessary to perform detection by the sensors and a correction operation for a phase difference. For example, when several print outs are repeated, time necessary for the respective print outs can be reduced.

As explained above, in the image forming apparatus including the plural endless photoconductive members having different angular velocities during rotation according to the embodiment of the present invention, it is possible to reduce occurrence of color drift in superimposed images making use of a cause based on a phase difference during rotation among the endless photoconductive members.

A driving mechanism for Bk (monochrome) is provided independently from the driving mechanisms for colors. The driving mechanisms for colors C (cyan), M (magenta), and Y (yellow) are integrated. Therefore, there is no increase in cost of the apparatus.

Further, the mechanism for detecting a difference in rotation phases uses a characteristic during molding of the gears of the driving mechanisms. This is advantageous in terms of cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color image forming apparatus comprising:

a first endless photoconductive member that holds a monochrome image;

a second endless photoconductive member that holds an image of a first color for obtaining a color image according to a subtractive process;

a third endless photoconductive member that holds an image of a second color for obtaining a color image according to the subtractive process;

a fourth endless photoconductive member that holds an image of a third color for obtaining a color image according to the subtractive process;

a first driving mechanism that imparts rotation for moving an image holding surface of the first endless photoconductive member in a predetermined direction;

a second driving mechanism that imparts rotation for moving image holding surfaces of the second, third, and fourth endless photoconductive members in a predetermined direction;

a first rotation detecting mechanism that detects a first rotation phase of the first driving mechanism;

a second rotation detecting mechanism that detects a second rotation phase of the second driving mechanism; and a rotation control mechanism that controls the rotation of the first driving mechanism and the second driving mechanism on the basis of detection results of the first rotation detecting mechanism and the second rotation detecting mechanism, after each of the first, second, third, and fourth endless photoconductive members has reached a uniform rotating speed after power is supplied.

2. The apparatus of claim 1, wherein the second driving mechanism rotates the image holding surfaces of the second, third, and fourth endless photoconductive members in a same phase.

3. The apparatus of claim 2, wherein the second driving mechanism includes a transmitting mechanism for transmitting rotation to the second, third, and fourth endless photoconductive members, and the transmitting mechanism supplies rotation received by one endless photoconductive members to the other endless photoconductive members.

4. The apparatus of claim 1, wherein the second driving mechanism does not rotate during monochrome image formation, which is performed by using only the first endless photoconductive member.

5. The apparatus of claim 1, further comprising:

an image holding member that holds the monochrome image held by the first endless photoconductive member, the image of the first color held by the second endless photoconductive member, the image of the second color held by the third endless photoconductive member, and the image of the third color held by the fourth endless photoconductive member; and a transfer mechanism that supplies an electric field for moving the monochrome image held by the first endless photoconductive member, the image of the first color held by the second endless photoconductive member, the image of the second color held by the third endless photoconductive member, and the image of the third color held by the fourth endless photoconductive member to the image holding member to allow the image holding member to hold the images.

6. The apparatus of claim 5, wherein the transfer mechanism displaces, when an image held by the image holding member is only the monochrome image held by the first endless photoconductive member, the image of the first color held by the second endless photoconductive member, the image of the second color held by the third endless photoconductive member, and the image of the third color held by the fourth endless photoconductive member from a first position where the image of the first color, the image of the second color, and the image of the third color is able to move for the image holding member to hold the images to a second position where the image of the first color, the image of the second color, and the image of the third color are not moved.

7. The apparatus of claim 1, wherein the first rotation detecting mechanism detects a rotation position informing mechanism integral with the first driving mechanism.

8. The apparatus of claim 1, wherein the second rotation detecting mechanism detects a rotation position informing mechanism integral with the second driving mechanism.

9. The apparatus of claim 8, wherein the second rotation detecting mechanism detects rotation for moving the image holding surfaces of the second, third, and fourth endless photoconductive members imparted to at least one of the second, third, and fourth endless photoconductive members by the second driving mechanism.

10. The apparatus of claim 1, wherein the first driving mechanism is able to rotate in an opposite direction.

11. The apparatus of claim 1, wherein the second driving mechanism is able to rotate in an opposite direction.

12. The apparatus of claim 1, wherein the rotation control mechanism controls the rotation of the first driving mechanism such that, when the monochrome image formation performed by only the first endless photoconductive member is finished, a phase of the first endless photoconductive member detected by the first rotation detecting mechanism coincides with phases of the second, third, and fourth endless photoconductive members detected by the second rotation detecting mechanism.

13. A color image forming apparatus comprising:

a first gear that imparts rotation to an image holding surface of a first endless photoconductive member that holds an image of a first color for obtaining a color image according to a subtractive process;

a second gear that imparts rotation to an image holding surface of a second endless photoconductive member that holds an image of a second color for obtaining a color image according to the subtractive process;

a third gear that imparts rotation to an image holding surface of a third endless photoconductive member that holds an image of a third color for obtaining a color image according to the subtractive process;

a fourth gear that imparts rotation to an image holding surface of a fourth endless photoconductive member that holds an image of a fourth color for obtaining a color image according to the subtractive process;

a first driving mechanism that imparts rotation to the first, second, and third gears;

a second driving mechanism that imparts rotation to the fourth gear;

a first rotation detecting mechanism that detects a position of a rotation informing mechanism integrally held by any one of the first, second, and third gears and detects a rotation phase;

a second rotation detecting mechanism that detects a position of a rotation informing mechanism integrally held by the fourth gear and detects a rotation phase; and a rotation control mechanism that controls the rotation of the first driving mechanism and the second driving mechanism on the basis of a detection results of the first rotation detecting mechanism and the second rotation detecting mechanism, after each of the first, second, third, and fourth endless photoconductive members has reached a uniform rotating speed after power is supplied.

14. The apparatus of claim 13, wherein the first driving mechanism rotates the first, second, and third gears in a same phase relationship.

15. The apparatus of claim 14, wherein the first driving mechanism includes an idle gear for coupling the first, second, and third gears to one another and drives only one of the first, second, and third gears.

16. The apparatus of claim 13, wherein the first driving mechanism is able to rotate in an opposite direction.

17. The apparatus of claim 13, wherein the second driving mechanism is able to rotate in an opposite direction.

18. The apparatus of claim 13, wherein the rotation control mechanism controls the rotation of the second driving mechanism such that, when the monochrome image formation performed by only the fourth endless photoconductive member is finished, a phase of the fourth gear detected by the second rotation detecting mechanism coincides with a phase of one of the first, second, and third gears that rotate the first, second, and third endless photoconductive members detected by the first rotation detecting mechanism.

19. A method for forming a color image comprising:

detecting a position of a rotation informing mechanism integrally held by one of first, second, and third gears to detect a first rotation phase change of at least one of the first, second, and third gears;

detecting a position of a rotation informing mechanism integrally held by a fourth gear to detect a second rotation phase change of the fourth gear; and setting, on the basis of the detected first rotation phase change and the detected second rotation phase change, phases during start of rotation of the respective gears such that a phase of a fourth image held by an image holding member rotated by the fourth gear coincides with phases of first, second, and third images held by respective image holding members rotated by the first, second, and third gears, after each of first, second, third, and fourth endless photoconductive members has reached a uniform rotating speed after power is supplied.

20. The method of claim 19, wherein the first, second, and third gears are coupled by an idle gear.

21. A color image forming apparatus comprising:

a first endless photoconductive member that holds a monochrome image;

a second endless photoconductive member that holds an image of a first color for obtaining a color image according to a subtractive process;

a third endless photoconductive member that holds an image of a second color for obtaining a color image according to the subtractive process;

a fourth endless photoconductive member that holds an image of a third color for obtaining a color image according to the subtractive process;

a first driving mechanism that imparts rotation for moving an image holding surface of the first endless photoconductive member in a predetermined direction;

a second driving mechanism that imparts rotation for moving image holding surfaces of the second, third, and fourth endless photoconductive members in a predetermined direction;

a first rotation detecting mechanism that detects a first rotation phase of the first driving mechanism;

a second rotation detecting mechanism that detects a second rotation phase of the second driving mechanism; and a rotation control mechanism that controls the rotation of the first driving mechanism and the second driving mechanism on the basis of detection results of the first rotation detecting mechanism and the second rotation detecting mechanism, after each of the first, second, third, and fourth endless photoconductive members has reached a uniform rotating speed.

* * * * *